US006695311B2

(12) United States Patent
Yu et al.

(10) Patent No.: US 6,695,311 B2
(45) Date of Patent: Feb. 24, 2004

(54) GUESS LOCATION GAME

(75) Inventors: Brian Yu, Hawthorne, CA (US); Jonathan Bedford, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,191

(22) Filed: Oct. 31, 2002

(65) Prior Publication Data

US 2003/0087686 A1 May 8, 2003

Related U.S. Application Data

(60) Provisional application No. 60/350,220, filed on Nov. 2, 2001.

(51) Int. Cl.[7] ..... A63F 3/00

(52) U.S. Cl. ..... 273/273; 273/293; 273/307; 463/11

(58) Field of Search ..... 273/273, 292, 273/293, 307; 463/9, 10, 11, 12, 13

(56) References Cited

U.S. PATENT DOCUMENTS 2,324,691 A 7/1943 Gardner
3,424,455 A 1/1969 Dunson
3,583,706 A * 6/1971 Glass et al. ..... 273/273
3,918,717 A 11/1975 Charves
4,036,493 A 7/1977 Breslow
4,640,510 A 2/1987 Braddock et al.
5,259,627 A * 11/1993 Alsip ..... 273/459

OTHER PUBLICATIONS

Race Game. The Price is Right. [online]. 1974, [retrieved on Mar. 4, 2003]. Retrieved from the internet: <URL:gscentral.net/race.htm>.*

* cited by examiner

*Primary Examiner*—Teresa Walberg
*Assistant Examiner*—Julie Brocketti
(74) *Attorney, Agent, or Firm*—Kolisch Hartwell PC

(57) ABSTRACT

A game including game pieces and rules for playing a game for a plurality of players, the goal of which is to score the most points by correctly guessing the location of hidden items. The invention provides multiple coverable items, multiple sets of markers, and multiple shells. Multiple coverable items may be hidden under multiple shells in a manner such that multiple sets of markers may be used to guess the location of the corresponding coverable items by stacking a marker onto the corresponding shell.

17 Claims, 3 Drawing Sheets

GUESS LOCATION GAME

CROSS REFERENCE TO RELATED APPLICATIONS

This application claims priority under 35 U.S.C. §119(e) to U.S. Provisional Patent Application No. 60/350,220 entitled "Guess Location Game," filed Nov. 2, 2001, the disclosure of which is incorporated herein by reference.

BACKGROUND OF THE INVENTION

The present invention relates generally to games played by multiple players. More specifically, the present invention relates to rules and apparatus for playing a memory based guessing game for multiple players.

Memory based guessing games have been in use for many years and are well known in the art of gaming. There exist at least two possible varieties of games with respect to their progression of play. Traditionally, memory games have relied on a "discover-remember-identify" progression of play that is exemplified by common card-matching memory games. Typically, the identities of face-down cards are discovered by a process of random guessing and subsequently remembered in order to eventually identify pairs of matching cards.

There also exists the possibility of a second category of memory based guessing games, in which the positions of particular items are initially known. These memory games, in contrast, would follow a "remember-identify" progression of play. In such games, the positions of particular items being initially known, the object would be to remember their locations throughout the course of play, which involves a rearrangement of the items, in order to identify them once more at the end.

Two common examples that follow this progression of play are The Shell Game and Three Card Monte. Both of these diversions are, commonly, simply scams or swindles based on sleight of hand or some other trick.

Another example is disclosed in variations of The Shell Game, in which a tosser seems to conceal an item, commonly a seed or ball, beneath one of three covers, which are typically small shells or cups. Once a player is confident (often falsely) that the item is under a particular cover, the tosser quickly mixes up the covers, often secretly removing the item or passing it to a different cover. Following the rearrangement of the covers, the player is prompted to wager on the final location of the concealed item. The player attempts to follow a "remember-identify" progression of play by tracking the supposed location of the item, but such is not possible due to the tosser's sleight of hand. Consequently, The Shell Game, while commonly promoted by tossers as a quick-thinking memory game, is in reality nothing of the sort, but is rather a misleading scam or, at best, a mere game of chance.

Three Card Monte, which commonly utilizes a standard deck of playing cards, is often similarly purported to be a memory game following a "remember-identify" progression. This diversion, also known as Find the Lady and Bonneteau, typically involves the use of two black cards and one red card, which is most commonly the Queen of Hearts. A tosser, or dealer, shows the three cards to a player and then places them face-down on a playing surface. In doing so, the tosser commonly disguises the location of the red card through a sleight of hand. After misidentifying the position of the red card to the player, the tosser quickly mixes up the cards. Then, after rearranging the cards, the tosser prompts the player to wager on the final position of the red card. As in The Shell Game, the player attempts to follow a "remember-identify" progression of play by tracking the supposed location of the red card. Likewise, such is not possible in Three Card Monte due to the tosser's deceptive sleight of hand.

Other types of memory based guessing games are disclosed in U.S. Pat. No. 5,259,627, the disclosures of which are incorporated herein by reference.

SUMMARY OF THE INVENTION

The present invention provides a game including game pieces and rules for playing a guess location game for a plurality of players. Specifically, the invention provides multiple coverable items, multiple sets of markers, and multiple shells. Multiple coverable items may be hidden under multiple shells in a manner such that multiple sets of markers may be used to guess the location of the corresponding coverable items. The advantages of the present invention will be more readily understood after a consideration of the drawings and the Detailed Description.

DETAILED DESCRIPTION OF A PREFERRED EMBODIMENT

Figure 1:
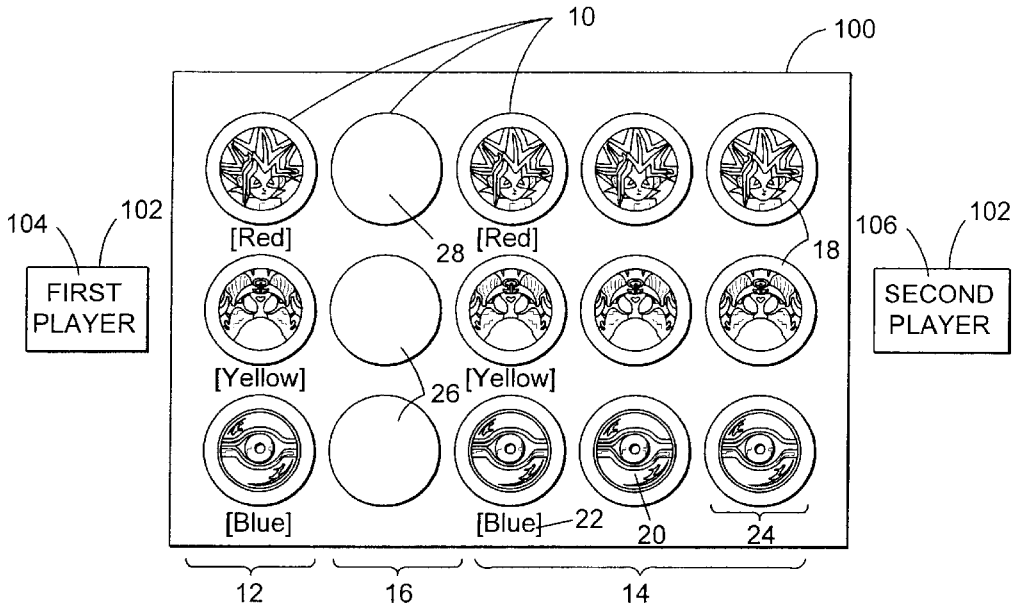
FIG. 1 depicts a playing area and available game pieces, including identical opaque shells and coverable items.

One method of playing the present guess location game is depicted in FIGS. 1–5. As demonstrated in FIG. 1, a playing area 100 is set up so that multiple players 102 may sit opposite each other, with playing area 100 in the middle. The multiple players 102 may include a first player 104 and a second player 106. Game pieces 10 are then distributed to players 102 as described below.

Game pieces 10 typically include multiple coverable items 12, multiple sets of markers 14, and multiple shells 16. Multiple coverable items 12 differ from one another by distinguishing traits 18, which may be represented by a picture 20, a color 22, or a combination of picture and color 24. Distinguishing traits 18 may be based on a popular cultural phenomenon, such as a book, movie, cartoon, or other game. For example, the characters shown in FIGS. 1–5 are based on the popular children's game Yu-Gi-Oh!, by Kazuki Takahashi.

Color 22 is indicated in FIG. 1 by the words "Red," "Yellow," and "Blue." These words would not typically be printed on the game pieces 10, and are for ease of understanding the present disclosure. Rather, the pieces 10 would be colored using a color scheme based on the indicated color.

Multiple sets of markers 14 contain at least one marker 14 per set. Markers 14 are provided with distinguishing traits 18 that correspond to those of coverable items 12 and thereby allow matching of markers 14 to specific coverable items 12. Markers 14 are also used to count points earned by players 102 for each appropriate match.

Multiple shells 16 typically are identical, opaque covers 26 and are used to cover and conceal distinguishing traits 18 of coverable items 12, thereby making the identity of coverable items 12 unknown. Shells 16 also each have a surface 28 that accommodates and facilitates stacking of multiple sets of markers 14 thereupon.

Figure 2:
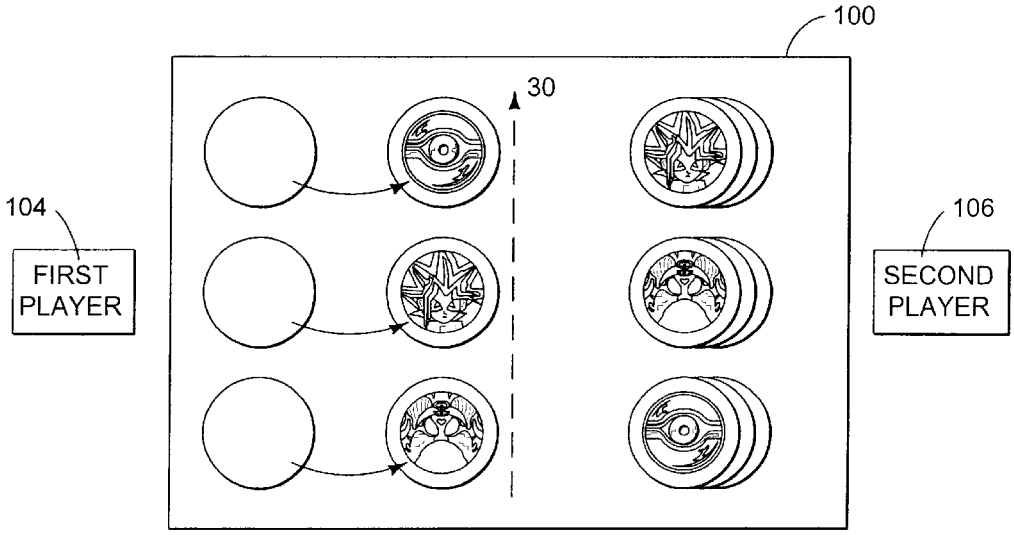
FIG. 2 shows a particular starting order of coverable items and game pieces used by each player, including stacks of game pieces.
Figure 3:
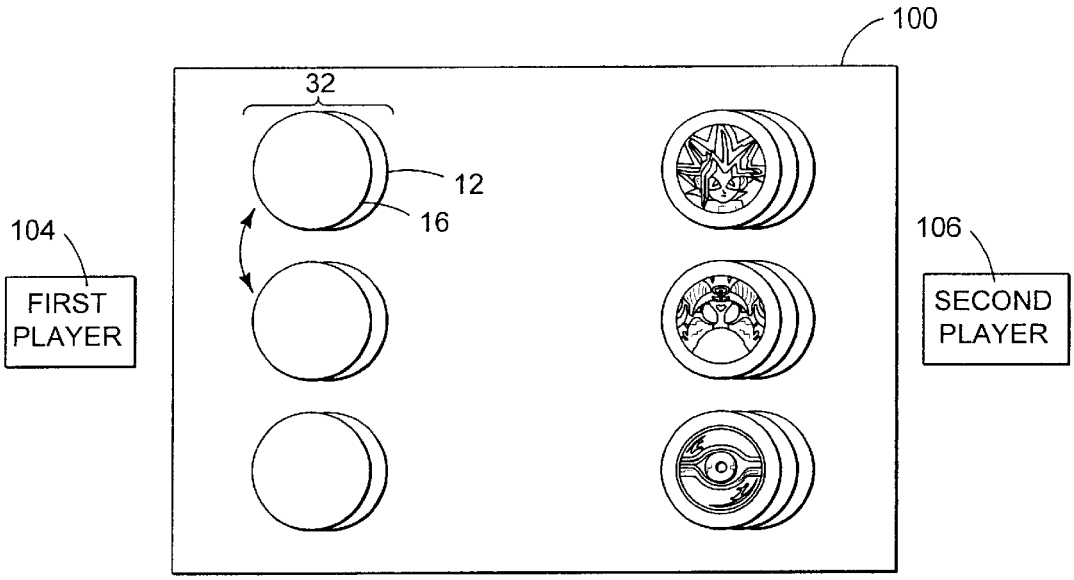
FIG. 3 shows a process of concealing the coverable items with the identical opaque shells and subsequent rearranging of stacks of game pieces.
Figure 4:
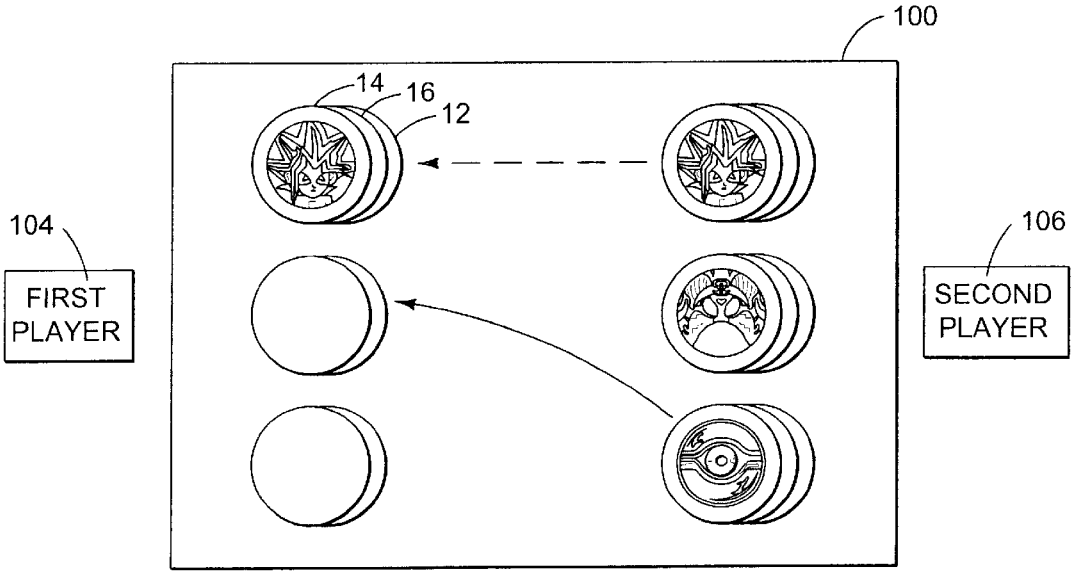
FIG. 4 shows a process of a player matching makers to his or her guess of corresponding stacks for each coverable item.

During play, first player 104 places coverable items 12 in a particular order 30 as shown in FIG. 2. Once second player 106 has viewed the particular order 30 of the coverable items 12, first player 104 then sets shells 14 over the coverable items 12 so that the distinguishing traits 14 are no longer visible and rearranges at least two of the stacks in an effort to confuse second player 106. In an attempt to match each marker 14 with that of its respective coverable item 12, second player 106 then places one of his or her multiple sets of markers 14 on top of what he or she believes to be the corresponding hidden coverable items 12, as demonstrated in FIGS. 3–4, so that stack 32 is formed and easily moveable. Game pieces 10 may take the form of tokens or chips so that when stacked, the number of markers 14 played remains visible.

Figure 5:
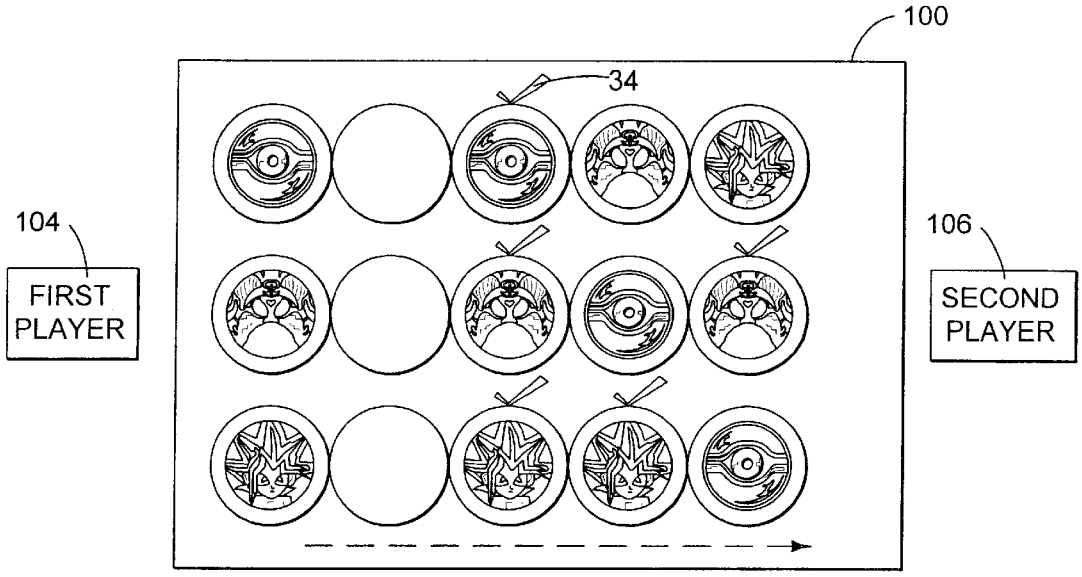
FIG. 5 depicts a scoring layout of game pieces.

First player 104 then rearranges the stacks 32 and second player 106 places his or her next set of markers 14 upon the corresponding hidden coverable items 12 for a predetermined number of times or until all of second player's 106 markers 14 have been added to the stacks 32. The markers 14, shells 16, and coverable items 12 are then unstacked so that each stack 32 remains separate from the others as shown in FIG. 5. Once shells 16 have been removed to expose the underlying coverable items 12, points 34 are awarded for second player 106, as shown in FIG. 5 by check marks placed next to correctly played markers 14. First 104 and second player 106 may then reverse roles and continue play for an agreed upon number of rounds or until one player 102 reaches an agreed upon number of points. Additionally, the player 102 determined to be the winner may then play against a different opponent, thereby facilitating round-robin tournament style play.

In one embodiment of the game the number of the multiple sets of markers 14 and the number of the multiple shells 16 is identical to the number of the multiple coverable items 12. Typically, the number of the multiple coverable items 12 is three, although other values may be used. The multiple sets of markers 14 also typically contain three matching markers 14 so that the rearranging and marking of coverable items 12 would be done in triplicate.

Although the invention has been disclosed in its preferred forms, the specific embodiments thereof as disclosed and illustrated herein are not to be considered in a limiting sense, because numerous variations are possible. The subject matter of the invention includes all novel and non-obvious combinations and subcombinations of the various elements, features, functions, and/or properties disclosed herein. No single feature, function, element or property of the disclosed embodiments is essential. The following claims define certain combinations and subcombinations of features, functions, elements, and/or properties that are regarded as novel and nonobvious. Other combinations and subcombinations may be claimed through amendment of the present claims or presentation of new claims in this or a related application. Such claims, whether they are broader, narrower, equal, or different in scope to any earlier claims, also are regarded as included within the subject matter of the invention.

What is claimed is:

1. A game for at least two players comprising:

multiple coverable items;

multiple shells; and multiple sets of markers, wherein:

the multiple shells are used to cover the multiple coverable items and have a surface to facilitate stacking of the multiple sets of markers; and the number of markers played is visible once stacked and the multiple sets of markers are used to mark the location of the multiple coverable items and count points earned by players.

2. A game in accordance with claim 1, wherein the multiple coverable items and the multiple sets of markers are related by distinguishing traits.

3. A game in accordance with claim 1, wherein the distinguishing traits are depicted by differences in picture, color, or a combination of picture and color.

4. A game for at least two players comprising:

multiple coverable items, each of the multiple coverable items including a distinguishing trait;

multiple sets of markers, each of the multiple sets of markers comprising at least one marker that includes a reference to the distinguishing trait of one of the multiple coverable items; and multiple shells, wherein each of the multiple shells is an identical, opaque cover sized to fit over any one of the multiple coverable items, and includes a surface that accommodates stacking of at least one set of markers thereupon so that such stacked set of markers remains visible.

5. A game in accordance with claim 4, wherein the distinguishing trait is depicted by differences in picture, color, or a combination of picture and color.

6. A game in accordance with claim 4, wherein the multiple sets of markers, the multiple shells, and the multiple coverable items are of an equal number.

7. A game in accordance with claim 6, wherein each of the multiple sets of markers comprises three matching markers.

8. A method of playing a memory game by multiple players, comprising the steps of:

placing multiple coverable items in a particular order, wherein the multiple coverable items differ from each other by distinguishing traits;

viewing the order of the multiple coverable items;

concealing the multiple coverable items by placing an identical cover over each of the multiple coverable items so that a stack is formed;

rearranging the order of at least two of the stacks;

stacking markers, each having distinguishing traits and corresponding to one of the multiple coverable items, upon each of the identical covers in an attempt to match each marker with that of its respective coverable item, the distinguishing traits of each marker being concealed so that the distinguishing trait of each marker is unknown once it is stacked upon one of the identical covers while the number of markers stacked is still visible;

repeating the above steps an agreed upon number of times;

removing all of the markers and placing them next to the respective identical covers upon which they had been stacked so that the distinguishing traits of the markers are visible;

removing the identical covers from the multiple coverable items to reveal the distinguishing trait and final position of each of the multiple coverable items; awarding a point for each of the markers that is correctly matched to its corresponding coverable item;

switching rolls and repeating all prior steps;

repeating all of the above steps for an agreed upon number of rounds, or until one player reaches an agreed upon number of points; and determining a winner to be a player who has the most points after the agreed upon number of rounds or who first reaches the agreed upon number of points.

9. A method of playing a memory game by multiple players in accordance with claim 8, wherein the distinguishing traits are pictures, colors, or a combination of pictures and colors.

10. A method of playing a memory game by multiple players in accordance with claim 8, wherein the step of rearranging of the order of the at least two of the stacks is performed on exactly two stacks.

11. A method of playing a memory game by multiple players in accordance with claim 8, wherein the agreed upon number of times is two, resulting in a total number of three times that a second player stacks the markers upon each of the identical covers.

12. A method of playing a memory game by multiple players in accordance with claim 8, further comprising the step of:

playing against a different opponent, thereby facilitating round-robin tournament style play.

13. A method of playing a memory game by multiple players, comprising the steps of:

placing multiple coverable items, each having distinguishing traits, in any order, oriented to be viewed by a player;

stacking a shell upon each of the multiple coverable items, each of the shells being an identical, opaque cover, completely concealing one of the multiple coverable items;

interchanging the order of at least two of the multiple coverable items and accompanying shell;

placing one marker, each marker having a distinguishing trait corresponding to that of one of the multiple coverable items, upon each of the shells in an attempt to stack each marker upon a corresponding coverable item so that the distinguishing trait of the marker is concealed, while the number of markers played remains visible;

repeating the above steps an agreed upon number of times, or until all of the markers have been stacked upon the shells;

removing the markers and arranging them next to the respective shells upon which they had been stacked so that the distinguishing traits of the markers are shown;

removing the shells from the coverable items to reveal the distinguishing traits of the coverable items upon which they were stacked;

awarding a point for each marker that is lined up next to its respective coverable item, as judged by matching of the distinguishing traits;

switching rolls and repeating prior steps;

repeating the above steps for an agreed upon number of rounds or until a player reaches an agreed upon number of points; and determining a winner to be a player who has the most points after the agreed upon number of rounds or who first reaches the agreed upon number of points.

14. A method of playing a memory game by multiple players in accordance with claim 13, wherein the distinguishing traits are pictures, colors, or a combination of pictures and colors.

15. A method of playing a memory game by multiple players in accordance with claim 13, wherein the step of rearranging of the order of the at least two of the stacks is performed on exactly two of the multiple coverable items and accompanying shells and markers.

16. A method of playing a memory game by multiple players in accordance with claim 13, wherein the step of interchanging the order of the at least two of the multiple coverable items and accompanying shells and markers is done a total of three times so that three markers are stacked upon each of the shells.

17. A method of playing a memory game by multiple players in accordance with claim 13, further comprising the step of:

playing against a different opponent, thereby facilitating round-robin tournament style play.

* * * * *